US006202235B1

(12) United States Patent
Salhanick

(10) Patent No.: US 6,202,235 B1
(45) Date of Patent: Mar. 20, 2001

(54) SITTING PAD

(76) Inventor: Brenda C. Salhanick, 4907 Harvest Hill, Dallas, TX (US) 75244

( * ) Notice: Subject to any disclaimer, the term of this patent is extended or adjusted under 35 U.S.C. 154(b) by 0 days.

(21) Appl. No.: 09/311,409

(22) Filed: May 13, 1999

(51) Int. Cl.[7] ..... A47C 20/02
(52) U.S. Cl. ..... 5/653; 5/417; 5/656; 40/320
(58) Field of Search ..... 5/417, 420, 653, 5/656, 657, 723; 297/219.1; D6/596, 601; 40/320, 725, 299.01

(56) References Cited

U.S. PATENT DOCUMENTS

| | | | | |
|---|---|---|---|---|
| D. 379,129 | * | 5/1997 | Yost et al. | D6/596 |
| 3,624,848 | * | 12/1971 | Nissen | 5/420 |
| 3,702,034 | * | 11/1972 | Pfeiffer | 40/320 |
| 3,837,104 | * | 9/1974 | Brotschi | 40/404 |
| 4,195,378 | * | 4/1980 | Parker | 5/419 |
| 4,215,498 | * | 8/1980 | Wilson | 40/665 |
| 4,309,784 | * | 1/1982 | Cohen | 5/639 |
| 4,466,516 | * | 8/1984 | Sicoli et al. | 5/419 X |
| 4,729,599 | * | 3/1988 | Nissen | 297/219.1 |
| 4,841,587 | * | 6/1989 | Carter et al. | 5/419 |
| 4,868,940 | * | 9/1989 | Masadi | 5/417 |
| 5,644,807 | * | 7/1997 | Batistella | 5/419 |
| 5,737,785 | * | 4/1998 | Casey | 5/419 |
| 5,950,260 | * | 9/1999 | Dees | 5/420 |
| 6,006,462 | * | 12/1999 | Lackomar | 40/593 |

* cited by examiner

*Primary Examiner*—Terry Lee Melius
*Assistant Examiner*—James M Hewitt

(57) ABSTRACT

A sitting pad for seating thereupon a plurality of users, such as the players of a sports team, in an organized manner. The sitting pad includes a flexible pad with upper and lower faces, a pair of end edges, and a pair of side edges extending between the end edges of the pad. The pad has a plurality of spaced apart pockets on the upper face of the pad. Each of the pockets comprising a translucent material. In each pocket is a name card with indicia denoting which user is to sit on the pad adjacent that particular pocket.

9 Claims, 2 Drawing Sheets

SITTING PAD

BACKGROUND OF THE INVENTION

1. Field of the Invention

The present invention relates to sitting pads and more particularly pertains to a new sitting pad for seating thereupon a plurality of users, such as the players of a sports team, in an organized manner.

2. Description of the Prior Art

The use of sitting pads is known in the prior art. More specifically, sitting pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,718,717 by Cruz; U.S. Pat. No. 5,292,177 by Balderi et al.; U.S. Pat. No. Des. 357,364 by Dionne et al.; U.S. Pat. No. 4,062,605 by Peters; U.S. Pat. No. 4,736,998 by Wilson et al.; and U.S. Pat. No. 4,406,495 by Turner et al.

While these devices fulfill their respective, particular objectives and requirements, the aforementioned patents do not disclose a new sitting pad. The inventive device includes a flexible pad with upper and lower faces, a pair of end edges, and a pair of side edges extending between the end edges of the pad. The pad has a plurality of spaced apart pockets on the upper face of the pad. Each of the pockets comprising a translucent material. In each pocket is a name card with indicia denoting which user is to sit on the pad adjacent that particular pocket.

In these respects, the sitting pad according to the present invention substantially departs from the conventional concepts and designs of the prior art, and in so doing provides an apparatus primarily developed for the purpose of seating thereupon a plurality of users, such as the players of a sports team, in an organized manner.

SUMMARY OF THE INVENTION

In view of the foregoing disadvantages inherent in the known types of sitting pads now present in the prior art, the present invention provides a new sitting pad construction wherein the same can be utilized for seating thereupon a plurality of users, such as the players of a sports team, in an organized manner.

The general purpose of the present invention, which will be described subsequently in greater detail, is to provide a new sitting pad apparatus and method which has many of the advantages of the sitting pads mentioned heretofore and many novel features that result in a new sitting pad which is not anticipated, rendered obvious, suggested, or even implied by any of the prior art sitting pads, either alone or in any combination thereof.

To attain this, the present invention generally comprises a flexible pad with upper and lower faces, a pair of end edges, and a pair of side edges extending between the end edges of the pad. The pad has a plurality of spaced apart pockets on the upper face of the pad. Each of the pockets comprising a translucent material. In each pocket is a name card with indicia denoting which user is to sit on the pad adjacent that particular pocket.

There has thus been outlined, rather broadly, the more important features of the invention in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sitting pad apparatus and method which has many of the advantages of the sitting pads mentioned heretofore and many novel features that result in a new sitting pad which is not anticipated, rendered obvious, suggested, or even implied by any of the prior art sitting pads, either alone or in any combination thereof.

It is another object of the present invention to provide a new sitting pad which may be easily and efficiently manufactured and marketed.

It is a further object of the present invention to provide a new sitting pad which is of a durable and reliable construction.

An even further object of the present invention is to provide a new sitting pad which is susceptible of a low cost of manufacture with regard to both materials and labor, and which accordingly is then susceptible of low prices of sale to the consuming public, thereby making such sitting pad economically available to the buying public.

Still yet another object of the present invention is to provide a new sitting pad which provides in the apparatuses and methods of the prior art some of the advantages thereof, while simultaneously overcoming some of the disadvantages normally associated therewith.

Still another object of the present invention is to provide a new sitting pad for seating thereupon a plurality of users, such as the players of a sports team, in an organized manner.

Yet another object of the present invention is to provide a new sitting pad which includes a flexible pad with upper and lower faces, a pair of end edges, and a pair of side edges extending between the end edges of the pad. The pad has a plurality of spaced apart pockets on the upper face of the pad. Each of the pockets comprising a translucent material. In each pocket is a name card with indicia denoting which user is to sit on the pad adjacent that particular pocket.

Still yet another object of the present invention is to provide a new sitting pad that has transparent pockets in which name cards may be placed to designate the location that a particular player is to sit on the sitting pad. This allows coaches and parents an easy means of keeping track of the players' names and which players are present.

Even still another object of the present invention is to provide a new sitting pad that may also be used to organize the seating of boy scout troops, girl scout troops, and students.

Still yet another object of the present invention is to provide a new sitting pad that may be rolled up when not in use for easy and convenient transport and storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new sitting pad embodying the principles and concepts of the present invention will be described.

In use, the sitting pad is designed for sitting thereupon by a plurality of users. As best illustrated in FIGS. 1 through 4, the sitting pad generally comprises a flexible pad with upper and lower faces, a pair of end edges, and a pair of side edges extending between the end edges of the pad. The pad has a plurality of spaced apart pockets on the upper face of the pad. Each of the pockets comprising a translucent material. In each pocket is a name card with indicia denoting which user is to sit on the pad adjacent that particular pocket.

Figure 3:
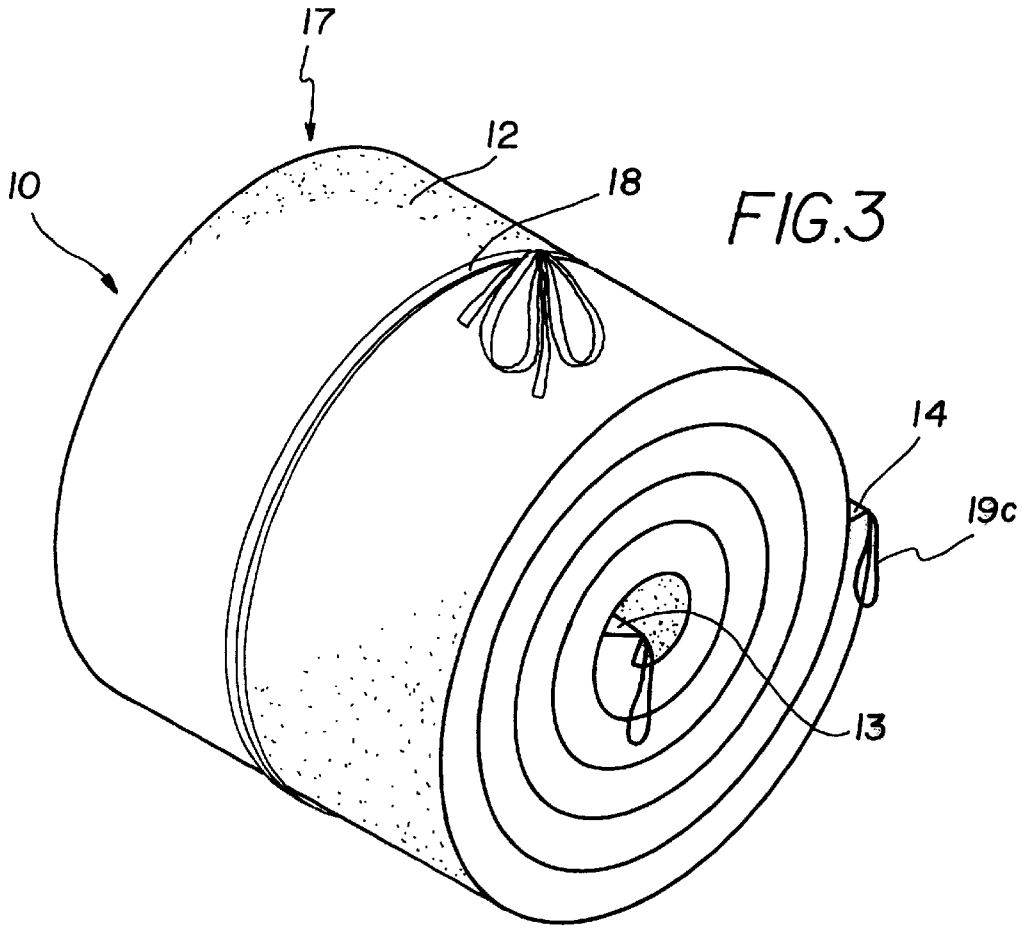
FIG. 3 is a schematic perspective view of the present invention in a rolled configuration for easy and convenient transport and storage of the present invention.

In closer detail, the sitting pad comprise a generally rectangular pad 10 having generally rectangular and generally planar upper and lower faces 11,12, a pair of spaced apart generally straight end edges 13,14, and a pair of spaced apart generally straight side edges 15,16 extending between the end edges of the pad. The pad comprising a flexible and resiliently deformable material capable of is rolled up into a roll 17 for easy and convenient transport and storage as illustrated in FIG. 3. Ideally, the pad comprises a foamed flexible and resiliently deformable material for making the pad light weight for easier carrying of the pad. When the pad is a rolled form, ideally, a rope or string 18 is wrapped around the pad in the rolled configuration to hold the pad in its rolled configuration as shown in FIG. 3.

Preferably, the upper and lower faces of the pad are generally parallel to one another. In this preferred embodiment, the end edges of the pad are extended generally parallel to one another and the side edges of the pad are extended generally parallel to one another and generally perpendicular to the end edges of the pad. The pad has a thickness defined between the upper and lower faces of the pad, a length defined between the end edges of the pad, and a width defined between the side edges of the pad. Preferably, the length of the pad is at least five times greater than the width of the pad so that multiple users may sit upon the pad at one time. In an ideal illustrative embodiment, the thickness of the pad is about 2 inches, the length of the pad is about 16 feet, and the width of the pad is about 2 feet.

Figure 1:
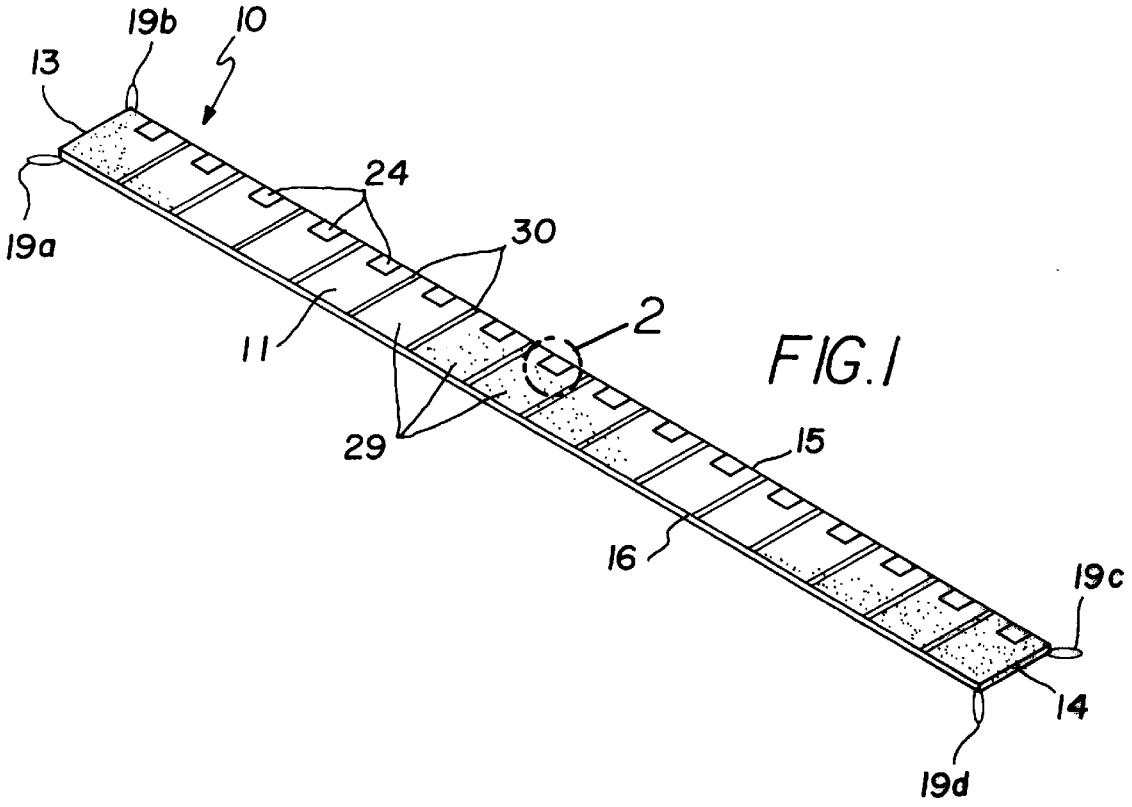
FIG. 1 is a schematic perspective view of a new sitting pad according to the present invention.
Figure 4:
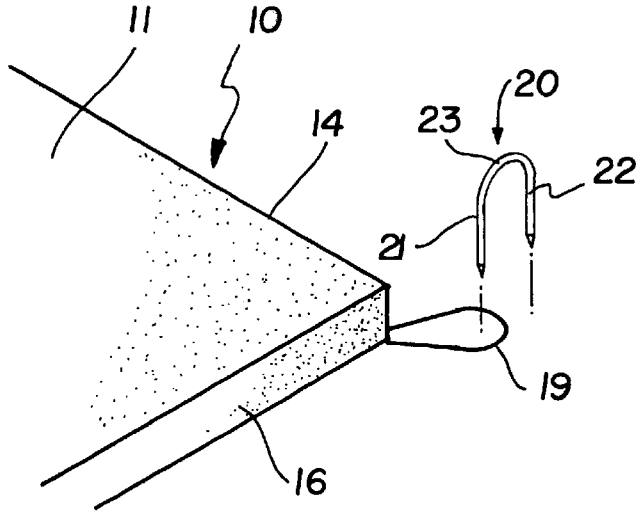
FIG. 4 is a schematic enlarge perspective view of the region adjacent a corner edge of the present invention illustrating the insertion of a ground spike through a loop of the pad.

In use, the bottom face of the pad is designed for resting on a ground surface. In a preferred embodiment, the pad has a plurality of flexible loops 19*a*,19*b*,19*c*,19*d* coupled thereto. Each of the loops is designed for anchoring the pad to the ground surface it is resting upon. The pad has a plurality of corner edges. Each of the corner edges of the pad is formed between an end edge of the pad and an adjacent side edge of the pad. As illustrated in FIGS. 1 and 4, preferably each of the corner edges of the pad has one of the loops located thereadjacent such that each loop outwardly extends from the respective adjacent corner edge.

A plurality of generally U-shaped ground spikes 20 are preferably provided with each ground spike having a pair of elongate arms 21,22 and an arcuate portion 23 connecting the arms of the respective ground spike together as illustrated in FIG. 4. The arms of each ground spike each preferably terminate at a pointed tip designed for insertion into the ground surface. In use, each of the ground spikes is associated with one of the loops of the pad with one of the arms of each ground spike being extended through the associated loop to anchor the associated loop to the ground surface as shown in FIG. 4.

Figure 2:
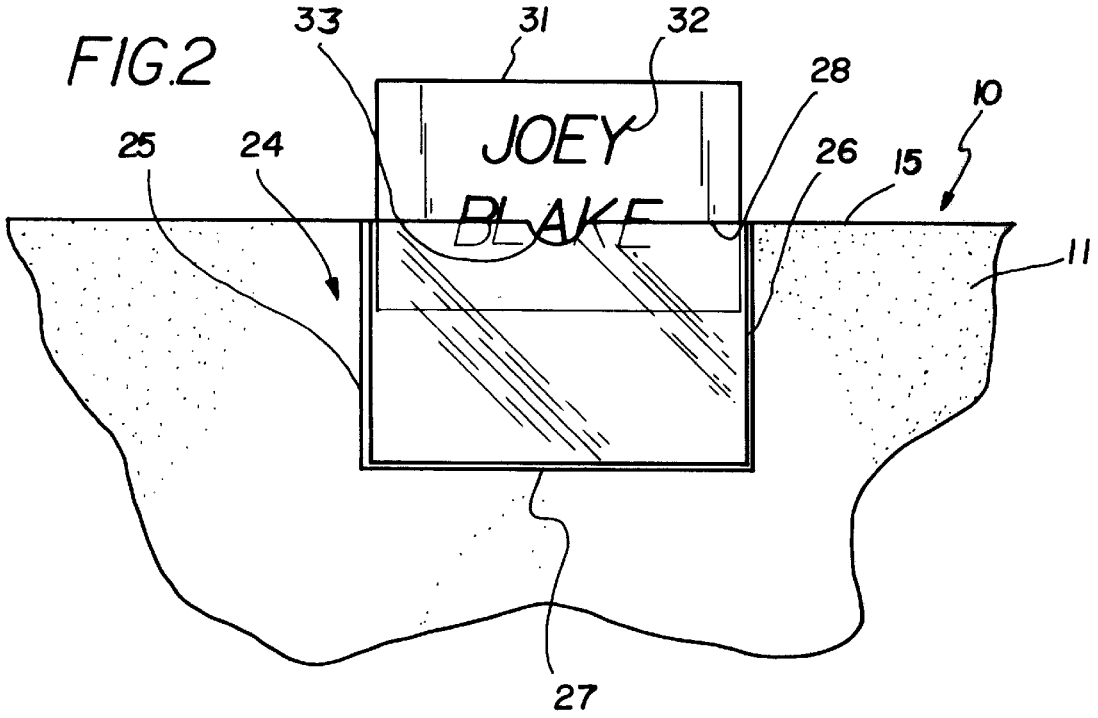
FIG. 2 is a schematic enlarged plan view of a pocket and name card of the present invention taken from circle 2 on FIG. 1.

The pad has a plurality of spaced apart pockets 24 on the upper face of the pad. Each of the pockets comprises a translucent (and ideally transparent) material to permit viewing of objects in the pocket. As best illustrated in FIG. 2, each of the pockets is generally rectangular and has an outer perimeter comprising a pair of ends 25,26 and a pair of sides 27,28. One of the sides 27 and both of the ends 25,26 of each pocket are coupled to the upper face of the pad such that the remaining side of each pocket defines an opening into the respective pocket.

The pockets are preferably arranged on the upper face of the pad in a row extending between the end edges of the pad. In this preferred embodiment, the row of pockets is extended generally parallel to the side edges of the pad. Ideally, the pockets are spaced apart at generally equal intervals in the row of pockets. Also ideally, each of the pockets is positioned adjacent one of the side edges of the pad with the opening of each pocket located adjacent the side edge that the respective pocket is positioned adjacent.

As best shown in FIG. 1, the upper face of the pad is divided into a plurality of generally equal sized rectangular sections 29. Each of the sections of the upper face of the pad has an associated pocket located therein so that each section has its own pocket. Preferably, the upper face of the pad has a plurality of section lines 30 thereon extending between the side edges of the pad, the section lines demarcating the boundaries between adjacent segments of the upper face of the pad.

Each of the pockets has a name card 31 therein. Each name card preferably has a name 32 of a user thereon denoting the named user sit in the section of the pocket has that name card therein.

In a preferred embodiment, each of the pockets has a generally semi-circular notch 33 in the side edge defining the opening into the respective pocket. In use, the notch is designed for making it easier to remove a name card from the pocket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sitting pad for designating a plurality of seating positions thereon, comprising:

a flexible pad having upper and lower faces, a pair of end edges, and a pair of side edges extending between said end edges of said pad;

said pad having a plurality of spaced apart pockets for receiving a card designating a person to occupy a seating position, said pockets being mounted on said upper face of said pad, each of said pockets comprising a translucent material;

wherein said pockets are arranged on said upper face of said pad in a row extending between said end edges of said pad;

wherein said upper face of said pad is divided into a plurality of generally equal sized sections corresponding to a seating position, wherein one of said pockets is located on each of said sections of said upper face of said pad, each of said pockets being centrally located along an upper edge of each of said sections.

2. The sitting pad of claim 1, wherein said pad comprises a resiliently deformable material.

3. The sitting pad of claim 2, wherein said pad comprises a foamed material.

4. The sitting pad of claim 1, wherein said pad has a length defined between said end edges of said pad, and a width defined between said side edges of said pad, wherein said length of said pad is at least five times greater than said width of said pad to permit seating of a plurality of users on said upper face of said pad.

5. The sitting pad of claim 1 wherein said pad has a plurality of flexible loops coupled thereto.

6. The sitting pad of claim 5, wherein said pad has a plurality of corner edges, each of said corner edges of said pad being formed between an end edge of said pad and an adjacent side edge of said pad, wherein each of said corner edges of said pad has one of said loops located thereadjacent.

7. The sitting pad of claim 5, further comprising a plurality of generally U-shaped ground spikes each having a pair of elongate arms and an arcuate portion connecting said arms of the respective ground spike together, said arms of each ground spike each terminating at a pointed tip, each of said ground spikes being associated with one of said loops of said pad, one of said arms of each ground spike being extended through the associated loop.

8. The sitting pad of claim 1, wherein said pockets are spaced apart at generally equal intervals in said row of pockets.

9. A sitting pad assembly for sitting thereupon by a plurality of users, comprising:

a generally rectangular pad having generally rectangular and generally planar upper and lower faces, a pair of spaced apart generally straight end edges, and a pair of spaced apart generally straight side edges extending between said end edges of said pad;

said pad comprising a flexible and resiliently deformable foamed material;

said upper and lower faces of said pad being generally parallel to one another;

said end edges of said pad being extended generally parallel to one another, said side edges of said pad being extended generally parallel to one another and generally perpendicular to said end edges of said pad;

said pad having a thickness defined between said upper and lover faces of said pad, a length defined between said end edges of said pad, and a width defined between said side edges of said pad;

wherein said length of said pad is at least five times greater than said width of said pad;

wherein said thickness of said pad is about 2 inches, said length of said pad is about 16 feet, said width of said pad is about 2 feet;

said lower face of said pad being adapted for resting on a ground surface;

said pad having a plurality of flexible loops coupled thereto, each of said loops being adapted for anchoring said pad to the ground surface said pad is resting on;

said pad having a plurality of corner edges, each of said corner edges of said pad being formed between an end edge of said pad and an adjacent side edge of said pad;

each of said corner edges of said pad having one of said loops located thereadjacent such that each loop outwardly extends from the respective adjacent corner edge;

a plurality of generally U-shaped ground spikes each having a pair of elongate arms and an arcuate portion connecting said arms of the respective ground spike together;

said arms of each ground spike each terminating at a pointed tip adapted for insertion into the around surface;

each of said ground spikes being associated with one of said loops of said pad, one of said arms of each ground spike being extended through the associated loop for anchoring said associated loop to the ground surface;

said pad having a plurality of spaced apart pockets on said upper face of said pad;

each of said pockets comprising a translucent material;

each of said pockets being generally rectangular and having all outer perimeter comprising a pair of ends and a pair of sides, one of said sides and both of said ends of each pocket being coupled to said upper face of said pad such that the remaining side of each pocket defines an opening into the respective pocket;

said pockets being arranged on said upper face of said pad in a row extending between said end edges of said pad, said row of pockets being extended generally; parallel to said side edges of said pad;

said pockets being spaced apart at generally equal intervals in said row of pockets;

said upper face of said pad being divided into a plurality of generally equal sized rectangular sections corresponding to a seating position, wherein one of said pockets is located on each of said sections of said upper face of said pad, each of said pockets being centrally located along an upper edge of each of said sections;

wherein each of said pockets is positioned adjacent one of said side edges of said pad, said opening of each pocket being located adjacent the side edge that the respective pocket is positioned adjacent;

said upper face of said pad having a plurality of section lines thereon extending between said side edges of said pad, said section lines demarcating boundaries between adjacent sections of said upper face of said pad;

wherein said plurality of section lines comprise a plurality of pairs of section lines, wherein said boundaries of each section is demarcated between said adjacent pairs of section lines;

each of said pockets having a name card therein, each name card having a name of a user thereon; and wherein each of said pockets having a generally semincircular notch in the side defining the openings into the respective pocket.

* * * * *